US005636690A

United States Patent [19]

Garay

[11] Patent Number: 5,636,690

[45] Date of Patent: Jun. 10, 1997

[54] TORQUE ANCHOR

[76] Inventor: Thomas W. Garay, 149 Coventry Place N.E. Calgary, Alberta, Canada, T3K 4A6

[21] Appl. No.: 546,527

[22] Filed: Oct. 20, 1995

[51] Int. Cl.[6] ..... E21B 23/01

[52] U.S. Cl. ..... 166/216; 166/217; 166/243

[58] Field of Search ..... 166/216, 210, 166/217, 243, 117.7

[56] References Cited

U.S. PATENT DOCUMENTS

| | | | |
|---|---|---|---|
| 1,110,639 | 9/1914 | Moore | 166/117.7 |
| 1,617,303 | 2/1927 | Dougherty | 166/117.7 |
| 2,665,888 | 1/1954 | Claypool et al. | 166/117.7 |
| 3,322,006 | 5/1967 | Brown | 166/117.7 X |
| 3,380,528 | 4/1968 | Timmons | 166/117.7 X |
| 4,580,631 | 4/1986 | Baugh | 166/208 |
| 4,583,590 | 4/1986 | Greenlee et al. | 166/216 |
| 4,811,785 | 3/1989 | Weber | 166/242 |
| 4,901,793 | 2/1990 | Weber | 166/68.5 |
| 5,275,239 | 1/1994 | Obrejanu | 166/210 |
| 5,350,013 | 9/1994 | Jani et al. | 166/217 |

FOREIGN PATENT DOCUMENTS

| | | |
|---|---|---|
| 1081613 | 7/1980 | Canada . |
| 1147258 | 5/1983 | Canada . |
| 1162845 | 2/1984 | Canada . |
| 1180594 | 1/1985 | Canada . |
| 1274470 | 9/1990 | Canada . |
| 1281998 | 3/1991 | Canada . |

*Primary Examiner*—Hoang C. Dang
*Attorney, Agent, or Firm*—Terrence N. Kuharchuk

[57] ABSTRACT

A torque anchor for the purpose of anchoring well equipment within a well conduit. The device anchors the well equipment from rotation in one direction but allows rotation in the other. The device has a body with slips and a driving portion within the slip. The slip has a friction surface which slides against the well conduit. This prevents damage to the gripping teeth or the well conduit. The slip has a gripping teeth portion which engages the well conduit only when the anchor is set. The slip is urged outward by the use of a spring. A portion of the slip is the drive surface which engages the driving portion. This drive surface is such that the perpendicular distance from the drive surface to the outer edge of the gripping teeth increases along the slip in the direction away from the friction surface. The slip has a portion which retains the slip within the anchor and thereby does not require any retaining means. The slip has a portion which abuts against the driving portion to allow rotation in the opposite direction. The anchor is set by rotation and is released by rotation in the opposite direction.

16 Claims, 2 Drawing Sheets

TORQUE ANCHOR

The invention relates to a device for anchoring well equipment within a well conduit.

BACKGROUND OF THE INVENTION

Various types of anchoring devices are currently available. The devices anchor the well equipment from movement vertically, in rotation or in both directions.

One type of anchor is described and illustrated in Canadian Patent No. 1,274,470 to Weber. This anchor has an inner mandrel within a slip and drag housing. Rotation of the mandrel drives the slips into engagement with the inner casing wall.

Another type of anchor is described and illustrated in U.S. Pat. No. 5,275,239 of Obrejanu. This anchor uses a housing with a plurality of anchoring mechanisms which rotate to engage the inner casing wall. The anchor also uses retaining means. The bite portion of the anchoring members also slide against the well casing in the non-locking orientation which can cause damage to either the bite portion of the anchoring member or the well casing.

The present invention provides an anchoring device that incorporates a friction surface which will not damage the well conduit. The present invention also does not require retaining means. The device provides a simple and low cost method of anchoring well equipment.

SUMMARY OF THE INVENTION

In accordance to one aspect of the invention, there is provided a device for anchoring well equipment against rotation within a well conduit. The device comprises a body attached to the well equipment. A plurality of slips having gripping teeth, a friction surface, and having portions defining a cavity. A spring urges the slip outward to cause a force between the friction surface and the inner well conduit wall. This force induces a frictional force between the friction surface and the inner well conduit wall which urges the slip to remain stationary without the gripping teeth contacting the inner well conduit wall. A means for driving is attached to the body and inserted through the slips such that upon rotation of the body in one direction the drive means rotate with the body and act on the slips to move the slips outward causing the gripping teeth to engage the inner well conduit wall. This prevents any further rotation in that direction.

In accordance with another aspect of the invention, there is provided a device for anchoring well equipment against rotation within a well conduit. The device comprises a body attached to the well equipment. A plurality of slips having gripping teeth, a friction surface, and a drive surface. The drive surface is such that the perpendicular distance from the surface to the outer edge of the gripping teeth increases along the slip in the direction of the setting motion. A spring urges the slip outward to cause a force between the friction surface and the inner well conduit wall. This force induces a frictional force between the friction surface and the inner well conduit wall to urge the slip to remain stationary without the gripping teeth contacting the inner well conduit wall. A means for driving is attached to the body such that upon rotation of the body in one direction the drive means rotate with the body and act on the slips to move the slips outward causing the gripping teeth to engage the inner well conduit. This prevents any further rotation in that direction.

Either device may also have slips having portions defining a cavity that encompasses the drive means so as to retain the slip within the device. The cavity may allow for movement of the slips away from or towards the centerline of the well conduit. The cavity may also have portions that may abut against the drive means and allow the device to rotate in the opposite direction.

Either device may also have a body which provides a passage to allow for the movement of fluid through the device.

BRIEF DESCRIPTION OF THE DRAWINGS

Further features and advantages of the invention will become apparent from the text set forth below, and the accompanying drawings.

DETAILED DESCRIPTION OF THE PREFERRED EMBODIMENT

Figure 1:
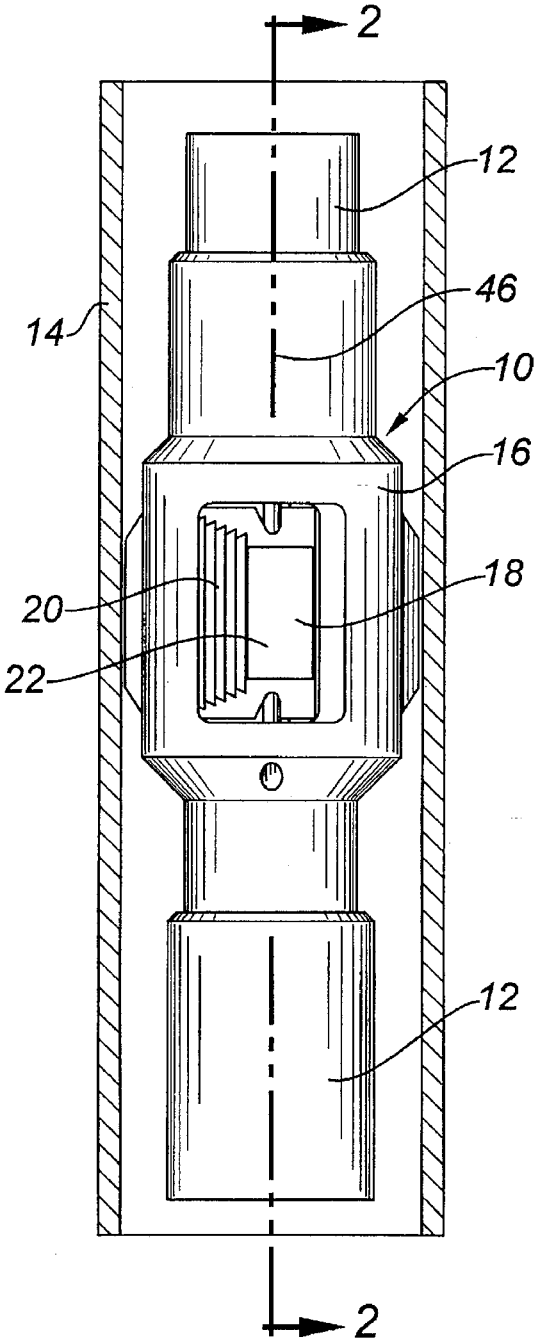
FIG. 1 is a side view of the anchor in accordance with the invention within the well conduit shown in section.

FIG. 1 shows an anchor 10, with the well equipment 12 attached above and below the anchor 10, within the well conduit 14. The generally cylindrical body 16 contains the slips 18. The gripping teeth 20 are shown as a portion of the slip 18. The friction surface 22 can also be seen as a portion of the slip 18.

Figure 2:
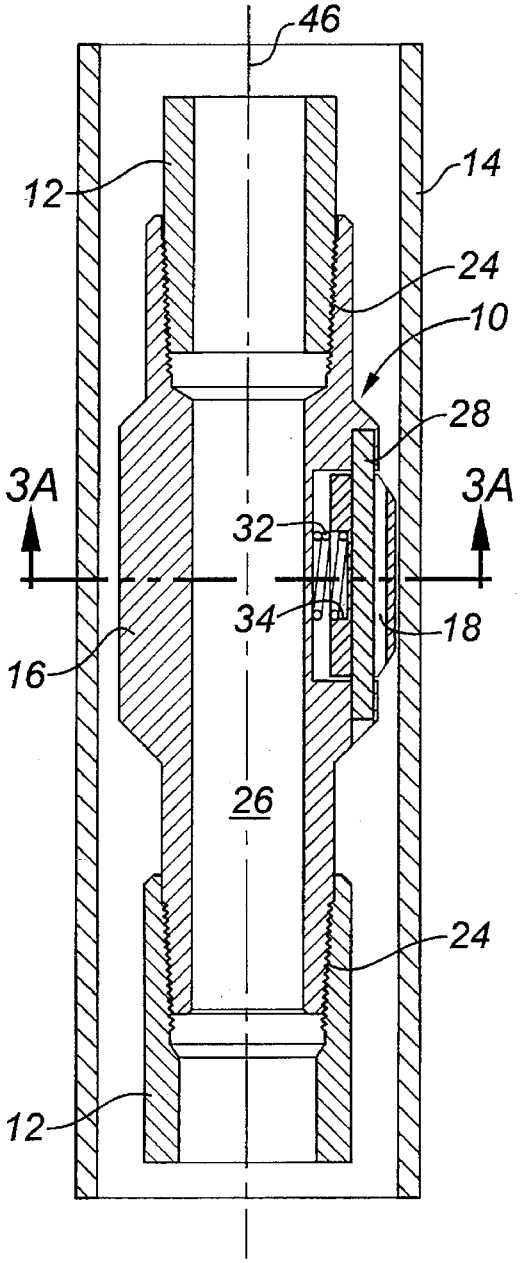
FIG. 2 is a section taken on the line A—A of FIG. 1.

FIG. 2 shows an anchor 10, with the well equipment 12 attached above and below the anchor 10, within the well conduit 14. The attaching threads 24 can be seen which attach the anchor 10 to the well equipment 12. The internal passage 26 can be seen by which the fluid is produced through. The drive means 28 can be seen to be inserted through the slip 18 and attached to the body 16 using threads 30. The spring 32 can be seen to urge between the body 16 and the slip 18. The spring 32 is retained by a recess 34 in the slip 18.

Figure 3A:
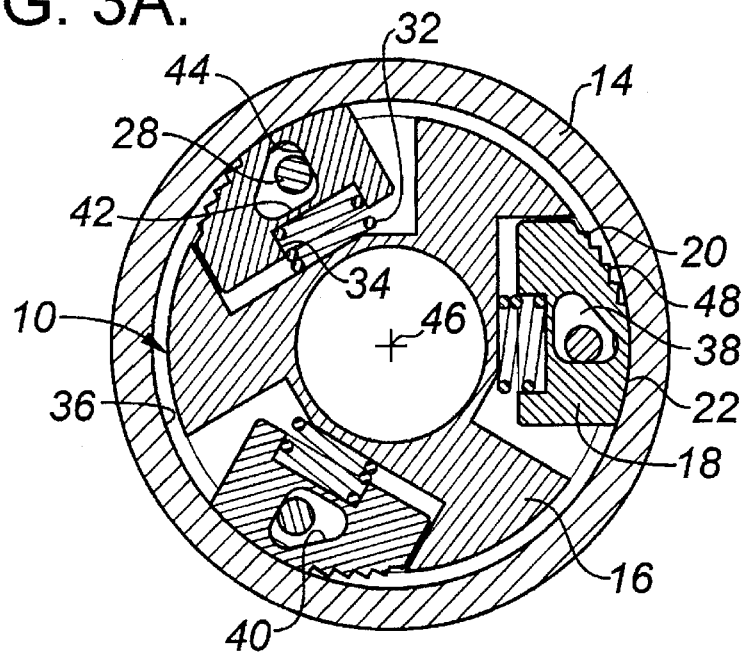
FIG. 3*a* is a section taken on the line B—B of FIG. 2 in the unset position.

FIG. 3*a* shows the section B—B from FIG. 2 in the unset position. The gripping teeth 20 can be seen in profile as well as the friction surface 22. The gripping teeth 20 are shown not to contact the well conduit 14. This results in less damage and wear of both the slip 18 and the well conduit 14. The friction surface 22 can be seen to be in contact with the well conduit 14. The spring 32 is within the recess 34 and cannot escape from the anchor 10. The spring 32 urges the slip 18 outward with a reaction force against the body 16. The slip 18 in turn forces outward against the well conduit 14 and contacts the inner well conduit wall 36. The result of this force is a frictional force which urges the slip 18 to remain stationary with respect to the drive means 28.

The drive means 28 can be seen within the cavity 38. The cavity 38 is defined by the drive surface 40, the retaining surface 42, and the abutment surface 44.

The cavity 38 is shown to allow the slip 18 to move away from or towards the centerline of the well conduit 46. The slip 18 can only move outward until the retaining surface 42 contacts the drive means 28. As a result of the contact the slip 18 cannot escape the anchor 10. The slip 18 can only move towards the centerline of the well conduit 46 until it contacts the body 16 or the drive surface 40 contacts the drive means 28. This movement allows for differences and variances in the internal diameter of the inner well conduit wall 36. The cavity 38 also is shown to allow the slip 18 to move tangentially to the inner well conduit wall 36. When the anchor 10 is rotated counterclockwise, when viewed from the top of the anchor 10, the drive means 28 can only move tangentially to the inner well conduit wall 36 until the drive means 28 contacts the abutment surface 44. The abutment surface 44 does not urge the slip 18 outwards which will allow the slip 18 to rotate with the drive means 28 and the anchor 10.

Figure 3B:
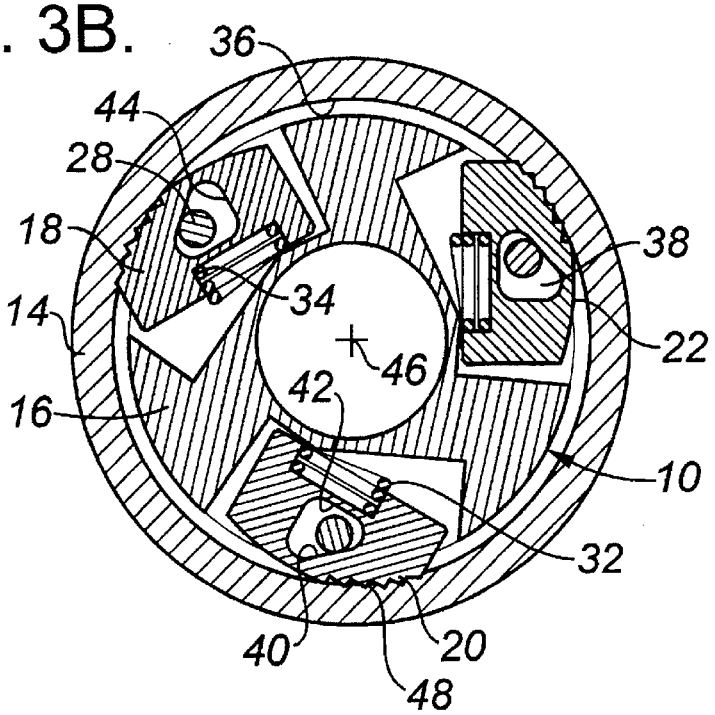
FIG. 3*b* is a section taken on the line B—B of FIG. 2 in the set position.

FIG. 3*b* shows the anchor 10 in the set position. The slips 18 are moved outward from the anchor 10 and the gripping teeth 20 are in contact with the inner well conduit wall 36. The setting of the anchor 10 occurs when the anchor 10 is rotated clockwise when viewed from the top of the anchor 10. The drive means 28 can only move tangentially to the inner well conduit wall 36 until the drive means 28 contacts the drive surface 40. The drive means 28 forces the slip 18 outward from the anchor 10. The slip 18 will move until the gripping teeth 20 contact the inner well conduit wall 36. Any further clockwise torque, when viewed from above the anchor 10, applied to the anchor 10 is transmitted to a force from the body 16 to the drive means 28 and further through to the slip 18 and finally in the inner well conduit wall 36. The outer edge of the gripping teeth 48 will bite into the inner well conduit wall 36 as a result of the force to prevent sliding. The perpendicular distance from the drive surface 40 to the outer edge of the gripping teeth 48 increases along the slip in the direction away from the friction surface 22. This is to ensure that any further movement as a result of further biting of the gripping teeth 20 into the inner well conduit wall 36 as a result of excessive force is accommodated.

The releasing of the anchor 10 occurs when the anchor 10 is rotated counterclockwise when viewed from the top of the anchor 10. The rotation of the body 16 causes the drive means 28 to be moved tangentially to the inner well conduit wall 36 away from the drive surface 40. The gripping teeth 20 then disengage from the inner well conduit wall 36. The anchor would return to the unset position shown in FIG. 3*a*. The anchor 10 can be either moved to a different position in the well conduit 14 and be reset or the anchor 10 can be removed from the well conduit 14.

Although only a single embodiment of the present invention has been described and illustrated, the present invention is not limited to the features of this embodiment, but includes all variations and modifications within the scope of the claims.

I claim:

1. In a device for anchoring well equipment against rotation within a well conduit having an inner well conduit wall, said device comprising:

a body attached to said well equipment;

a plurality of slips movably mounted to the body having gripping teeth and a friction surface for alternately engaging the inner well conduit wall, wherein each slip defines an aperture extending therethrough;

a spring for urging each slip outward from the body such that the friction surface engages the inner well conduit wall with a force which induces a frictional force between said friction surface and the inner well conduit wall to urge the slip to remain stationary without said gripping teeth contacting the inner well conduit wall; and a means for driving the slips attached to said body and extending through the aperture of each slip such that said driving means rotate with the body and mount the slip to the body and such that upon rotation of said body in one direction, said driving means act on the slip to cause said gripping teeth to engage the inner well conduit wall in order to inhibit the rotation of the body in that direction.

2. The device of claim 1 wherein the slip has portions defining said aperture which allows for movement of the slip away from or towards the inner well conduit wall.

3. The device of claim 1 wherein the slip has portions defining said aperture which may abut against said driving means and allow said device to rotate in the opposite direction.

4. The device of claim 1 wherein said body provides portions defining a passage to allow for the movement of fluid through said device.

5. The device of claim 1 wherein the slip has portions defining said aperture which allows for movement of the slip away from or towards a centerline of said well conduit and portions defining said aperture which may abut against said driving means and allow said device to rotate in the opposite direction.

6. The device of claim 3 wherein said body provides portions defining a passage to allow for the movement of fluid through said device.

7. The device of claim 2 wherein said body provides portions defining a passage to allow for the movement of fluid through said device.

8. The device of claim 5 wherein said body provides portions defining a passage to allow for the movement of fluid through said device.

9. In a device for anchoring well equipment against rotation within a well conduit having an inner well conduit wall, said device comprising:

a body attached to said well equipment;

a plurality of slips movably mounted to the body having gripping teeth and a friction surface for alternately engaging the inner well conduit wall, wherein each slip defines an aperture extending therethrough and has a drive surface such that the perpendicular distance for said drive surface to the outer edge of said gripping teeth increases along the slip in the direction of a set position;

a spring for urging each slip outward from the body such that the friction surface engages the inner well conduit wall with a force which induces a frictional force between said friction surface and the inner well conduit wall to urge the slip to remain stationary without said gripping teeth contacting the inner well conduit wall; and a means for driving the slips attached to said body and extending through the aperture of each slip such that said driving means rotate with the body and mount the slip to the body and such that upon rotation of said body in the direction of the set position, said driving means act on the slip to cause said gripping teeth to engage the inner well conduit wall in order to inhibit the rotation of the body in that direction.

10. The device of claim 9 wherein the slip has portions defining the aperture which allows for movement of the slip away from or towards the centerline of said well conduit.

11. The device of claim 9 wherein the slip has portions defining the aperture which may abut against said driving means and allow said device to rotate in the opposite direction.

12. The device of claim 9 wherein said body provides portions defining a passage to allow for the movement of fluid through said device.

13. The device of claim 9 wherein the slip has portions defining said aperture which allows for movement of the slip away from or towards the centerline of said well conduit and portions defining said aperture which may abut against said driving means and allow said device to rotate in the opposite direction.

14. The device of claim 11 wherein said body provides portions defining a passage to allow for the movement of fluid through said device.

15. The device of claim 10 wherein said body provides portions defining a passage to allow for the movement of fluid through said device.

16. The device of claim 13 wherein said body provides portions defining a passage to allow for the movement of fluid through said device.

* * * * *